United States Patent [19]

Engler et al.

[11] Patent Number: 4,520,615

[45] Date of Patent: Jun. 4, 1985

[54] TUBE FORMING APPARATUS FOR PACKAGING

[75] Inventors: Peter B. Engler, River Falls; Stanley D. Denker, New Richmond, both of Wis.

[73] Assignee: Doboy Packaging Machinery, Inc., New Richmond, Wis.

[21] Appl. No.: 470,194

[22] Filed: Feb. 28, 1983

[51] Int. Cl.[3] ..... B65B 9/06; B65B 9/10

[52] U.S. Cl. ..... 53/550; 493/302; 493/439; 493/248

[58] Field of Search ..... 53/550, 575, 551, 568; 198/689; 493/302, 439, 438, 248, 418, 450

[56] References Cited

U.S. PATENT DOCUMENTS

| | | | |
|---|---|---|---|
| 2,099,257 | 11/1937 | Bergstein . | |
| 2,432,373 | 12/1947 | Bleam et al. | 53/551 |
| 3,007,295 | 11/1961 | Heinzer . | |
| 3,059,391 | 10/1962 | Volks et al. . | |
| 3,471,993 | 10/1969 | Monsees et al. | 53/550 |
| 3,581,457 | 6/1971 | Gerlach et al. . | |
| 3,667,971 | 6/1972 | Brunner . | |
| 3,688,468 | 9/1972 | Erekson . | |
| 4,040,237 | 8/1977 | O'Brien | 53/551 |
| 4,073,116 | 2/1978 | Glover . | |
| 4,218,863 | 8/1980 | Howard et al. | 53/550 |
| 4,304,508 | 12/1981 | Wolf | 198/689 |
| 4,430,844 | 2/1984 | James | 53/550 |

*Primary Examiner*—Daniel C. Crane

*Attorney, Agent, or Firm*—Orrin M. Haugen; Thomas J. Nikolai; Douglas L. Tschida

[57] ABSTRACT

Method and apparatus for forming a tube from a web of paper or film. A perforated endless belt has at least one vacuum box applied to the underside of one run. The web is fed onto the belt and held down by it. The leading portion of the web is folded rearwardly and the longitudinal edges of the web are folded inwardly to create a tube. The thus formed tube is continuously withdrawn rearwardly while product is inserted into the opening which is continuously being formed in the tube. The tube is longitudinally sealed and thereafter transversely sealed and transversely cut to form individual pouches.

6 Claims, 2 Drawing Figures

TUBE FORMING APPARATUS FOR PACKAGING

This invention relates to packaging apparatus, and more particularly, the invention is directed to a method and apparatus for forming a tube from a web, the product to be packaged being inserted into said tube as it is being continuously formed.

It is known to feed a web through a former, the former having guides which reverse the direction of movement of the web and turn the longitudinal edges of the web inwardly to form a tube. The thus formed tube is continuously fed with literature from a collator such as a Pitney Bowes collator. The tube is thereafter longitudinally sealed and transversely sealed between the packaged materials and transversely cut. An example of a structural former is disclosed in copending application Ser. No. 220,260, filed Dec. 24, 1980, now U.S. Pat. No. 4,430,845.

The apparatus just described has at least two significant disadvantages. First, it has not been possible to run paper through the former successfully. In the areas where the paper is folded upon itself to create corners, "crows feet" appear making the resulting package unsightly and frequently the paper tears.

The second disadvantage is that the former wears out, particularly when running at high speeds.

An objective of the present invention has been to provide an improved former suitable for running paper and suitable for running film or paper at high speed with no parts being subjected to a significant amount of abrasion which cause them to wear prematurely.

This objective of the invention is attained by providing a perforated endless belt driven in a first direction. The belt has a horizontal run and vacuum is applied to the underside of the horizontal run. A web of paper or film is fed onto the horizontal run and is held down on the belt by the vacuum. The leading portion of the film is folded rearwardly with the longitudinal edges being folded inwardly to form a tube. The tube is continuously withdrawn rearwardly.

If product is fed continuously onto the tube at its mouth where it is being formed, the web will maintain its position on the endless belt and the tube will be continuously formed without requiring a structural former having guide elements and the like to cause the web to follow a predetermined path. It is preferred, however, to place two laterally spaced guide fingers in the entrance to the tube, the guide fingers serving to guide product into the tube and to maintain the tube properly positioned on the perforated belt.

Another feature of the invention is to provide such guide fingers with a substantial vertical dimension so as to create a tube of rectangular cross section. Another feature of the invention is to vary the width of the tube by varying the space between the fingers.

Another feature of the invention is to apply a vacuum to another section of the perforated belt upstream of the horizontal run. That vacuum and perforated belt combination functions as a power unwind which withdraws the web from a roll located adjacent the perforated belt without applying any tension to that portion of the web which is on the horizontal run of the perforated belt. Thus, the power unwind is attained with no more additional expense than adding another vacuum box from the vacuum supply which is necessarily present for the operation of the tube-forming portion of the invention.

The several objectives and features of the invention will become more readily apparent from the following detailed description taken in conjunction with the accompanying drawings in which.

Figure 1:
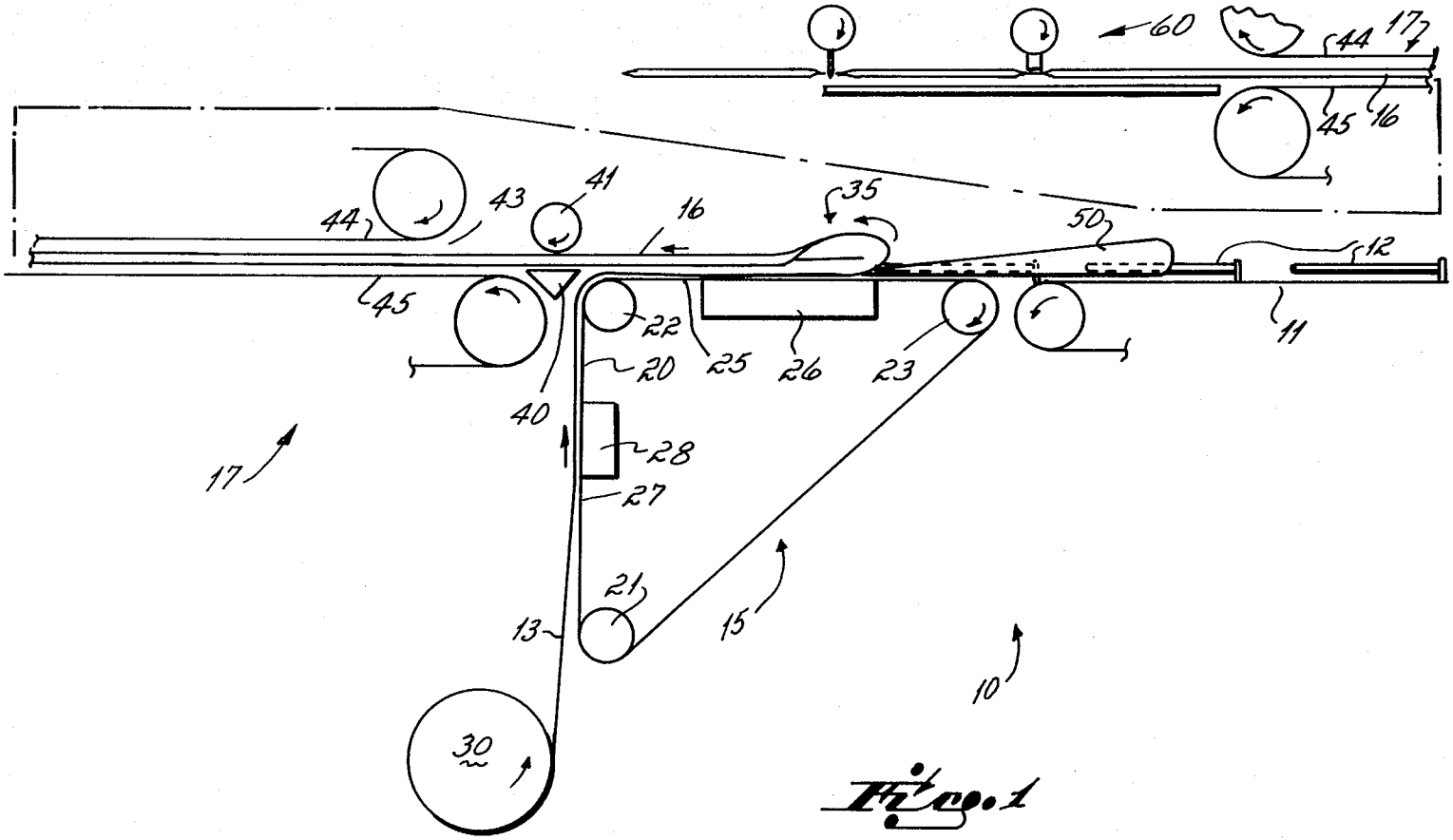
FIG. 1 is a diagrammatic side elevational view of the invention.

The packaging apparatus is shown at 10 in FIG. 1. It includes an infeed conveyor 11 carrying literature 12 to be wrapped in a web 13. The web is passed over a former 15 to create a tube into which the literature or other discrete product is inserted. The tube with the literature inserted is drawn rearwardly as indicated at 16 by an outfeed conveyor 17.

The heart of the invention is in the former 15. The former includes an endless perforated belt 20 passing around two idler rolls 21, 22 and a driven roll 23. A motor, not shown, is drivably connected to the driven roll 23 to continuously drive the perforated belt. The belt has a horizontal run 25 over which the web 13 passes. A vacuum box 26 is applied to the underside of the web, the vacuum of the box being connected to a vacuum source (not shown) which applies a vacuum of about 5 inches of mercury to the box. The belt has a vertical run 27 and preferably a vacuum box 28 is applied to the underside of the vertical run to form a power unwind. The power unwind draws the web 13 from a supply roll 30 located adjacent the former 15.

The belt 20 is shown as passing over three rolls to present a triangular configuration. It should be understood that the belt could pass over only rolls 22 and 23 to provide a lower horizontal run. That run, cooperating with vacuum box 26 open at its underside, could provide the power unwind.

Figure 2:
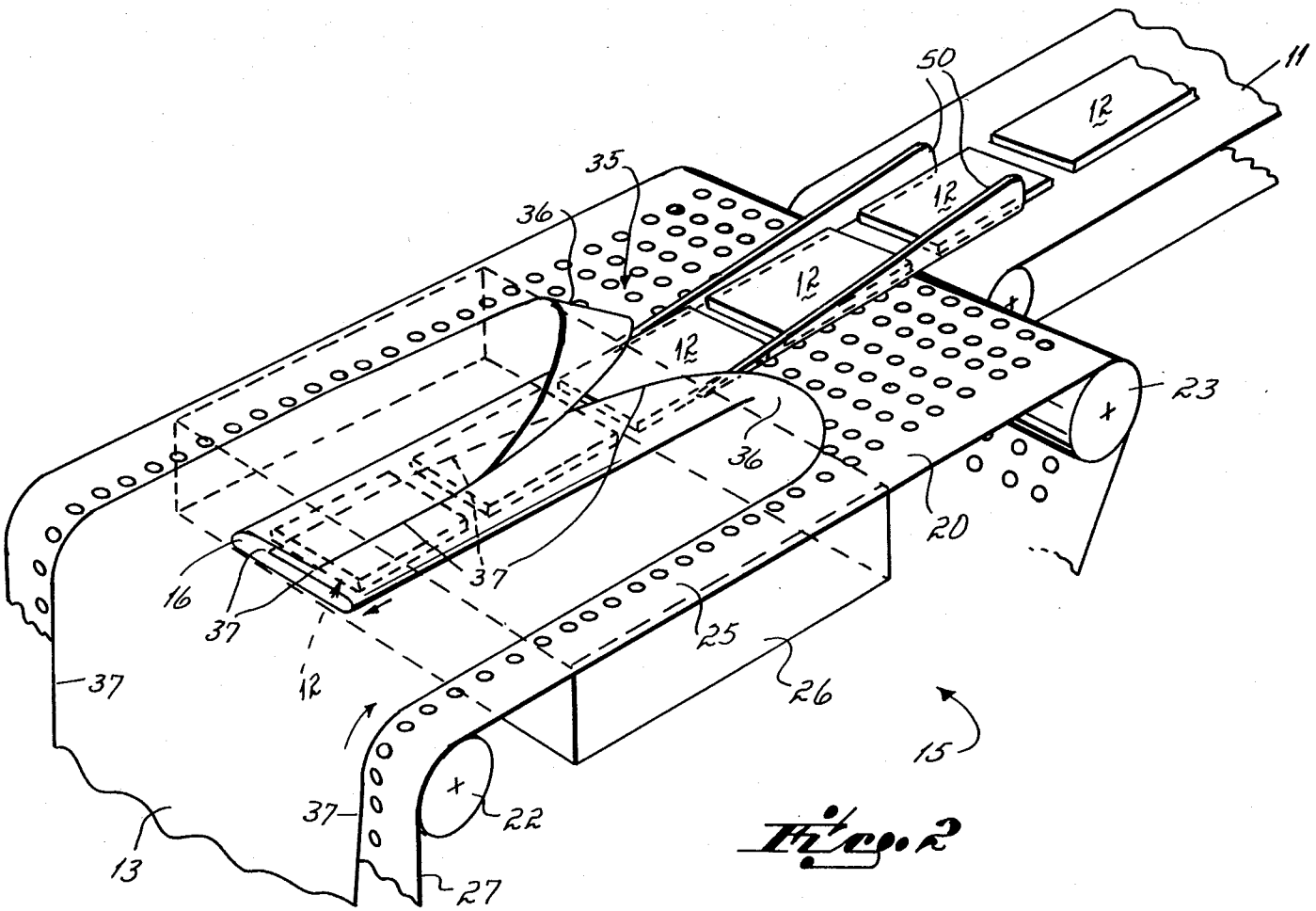
FIG. 2 is a fragmentary perspective view of the tube-forming portion of the invention.

On the horizontal run, the web is initially fed in the direction of the movement of the belt and carried by the belt to a location intermediate the ends of the horizontal run. The leading portion of the web indicated at 35 is folded rearwardly on a continuously changing fold 36. Simultaneously, the longitudinal edges 37 of the web are folded inwardly, as best shown in FIG. 2, with a slight overlap for the purpose of forming a seal. The thus formed tube passes over a support plate 40 and the overlapping edges are engaged by a sealing device 41. After sealing, the tube passes into a nip 43 formed by the upper and lower belts 44, 45 which constitute the outfeed conveyor 17. The belts are continuously driven to apply tension to the web and to continuously draw it off the perforated belt where the tube is being formed. If the lower belt 45 is a vacuum belt, the upper belt 44 could be eliminated.

The infeed conveyor 11 continuously deposits product into the tube, the product in the illustrated form of the invention being a small stack of collated literature. A pair of guides 50 (FIG. 2) project from the infeed conveyor into the tube. The guides perform several functions. They guide product from the infeed conveyor into the tube. They determine the lateral spread of the tube. They can be vertically dimensioned in order to create a rectangular tube as contrasted to a flat tube. They can also control the lateral position of the overlap or longitudinal seal so that such seal could be located at the edge of the tube or at any other lateral position including its center, as shown. Further, by changing the configuration of the fingers, the tube can be kept open longer to permit the insertion of an additional product such as a pencil downstream from the point at which the literature is inserted.

It appears that as long as there is a continuous supply of product such as the literature, the guide fingers are not critical to the operation of the former since the product itself maintains the lateral dimension of the tube. However, the guides do provide assurance that in the event of a discontinuity in the flow of product, the tube will be maintained at the desired size and positioned on the perforated belt.

After the tube with product in it has been longitudinally sealed and conveyed in the nip of the outfeed conveyor, it passes through a transverse sealer and cutter indicated diagrammaticallly at 60, thereby completing the formation of the package. This can be a two-stage cutter and sealer, as shown, or a single stage cutter and sealer, as is well known in the art.

In the operation of the invention, vacuum is applied to the perforated belt at the boxes 26 and 28. The web 13 is applied to the surface of the belt with a leading section extending beyond the belt. The leading section is first folded rearwardly and then the longitudinal edges are folded inwardly into an overlapping relationship to create the tube. That section is fed into the nip formed between the belts 44 and 45. With the web in position, the apparatus can be started up with synchronized drives to the infeed conveyor, the perforated belt and the outfeed conveyor. As the perforated belt moves in a clockwise direction, as viewed in FIG. 1, the vertical run 27 with the vacuum applied to it pulls the web from the supply roll 30. The vacuum box 26, acting on the horizontal run of the belt, causes the horizontal run of the belt to continuously pull fresh supply of web up to the point at which the tube is formed. The tube is continuously formed by the withdrawing of the leading portion of the web by means of the outfeed conveyor 17. Simultaneously with this operation, product is delivered into the opening of the tube. As the tube passes under the sealer 41, a longitudinal seal is formed. As the tube passes the cutting and sealing station, a transverse seal is formed and the web is transversely cut to form the individual packages.

Throughout this operation, there is no requirement for stationary structural elements to engage the web except for the optional and minor engagement of the web by the two guide fingers 50. Hence, there is no stress imparted to a paper web such as would cause tearing or at least crows feet developing at the corners, and there is no expensive former to wear out by the abrading action of the paper passing over it.

An edge detector such as an electric eye may be located at the upstream edge of the web to maintain its location in proper relation to the infeed of product. Such detector could control the speed of belt 45 to keep the edge of the web properly positioned.

Having described our invention, we claim:

1. Apparatus for making a packaging tube from a web of paper or film comprising:

an endless, perforated belt having a flat run;

means driving said belt through said flat run in a first direction;

vacuum box means having an upstream and downstream end for applying a vacuum to the underside of said flat run;

means for continuously supplying said web to the flat run of said perforated belt to pull said web in said first direction toward said downstream end;

rotary web-engaging means disposed proximate said upstream end for withdrawing said web from said flat run by drawing said web in a direction opposite to said first direction;

said web being folded to flow in said opposite direction and to turn the side edges of said web inwardly upon itself, continuously forming a tube moving in said opposite direction without use of an intervening edge member for defining fold lines;

said vacuum box means being positioned at the location where said web is folded to flow in the opposite direction to form said tube.

2. Apparatus as in claim 1 and further comprising a pair of spaced guide bars disposed proximate said downstream end of said vacuum box means at the location where said web is folded to flow in said opposite direction and projecting into the entrance of said tube as it is continuously formed.

3. Apparatus as in claim 2 in which a product to be packaged is guided into said tube by said guide bars.

4. Apparatus as in claim 1 in which said endless, perforated belt has an upstream run adjacent to and at an angle to said flat run;

means for applying a vacuum to said upstream run for adhering said web thereto;

and a supply roll of web adjacent said upstream run whereby said upstream run serves to draw said web from said supply roll prior to entering said flat run.

5. Apparatus for making a packaging tube from a web of paper or film comprising:

an endless perforated belt having a vertical run intersecting with a horizontal run and a return to said vertical run, said endless belt being driven in a first direction;

vacuum box means applied to said vertical and horizontal runs;

a supply roll of web adjacent said vertical run permitting said vertical run to function as a power unwind for said supply roll;

an outfeed conveyor adjacent the intersection of said vertical and horizontal runs, said outfeed conveyor having a nip driven in a second direction opposite said first direction for drawing web away from said horizontal run;

said web passing over said vertical run and said horizontal run and then being reversed in the direction of flow from said first direction and fed into said nip, said web being folded back upon itself and its longitudinal edges turned inwardly along fold lines to overlap one another and forming a tube without contact with other web direction changing structure proximate said fold lines;

said vacuum box means being positioned at the location where said web is reversed and folded back upon itself to form said tube;

and means for feeding product sequentially into said tube.

6. Apparatus as in claim 5 further comprising, means for applying a longitudinal seal to said longitudinal edges of said tube;

and means for transversely sealing and cutting said tube between products contained within said tube.

* * * * *